US008425336B2

(12) United States Patent
Munzlinger

(10) Patent No.: US 8,425,336 B2
(45) Date of Patent: Apr. 23, 2013

(54) APPARATUS AND METHOD FOR PROVIDING AN IN-STORE CUSTOMER TEST TRACK

(76) Inventor: David Munzlinger, Richmond, VA (US)

( * ) Notice: Subject to any disclaimer, the term of this patent is extended or adjusted under 35 U.S.C. 154(b) by 146 days.

(21) Appl. No.: 12/473,018

(22) Filed: May 27, 2009

(65) Prior Publication Data

US 2009/0298602 A1 Dec. 3, 2009

Related U.S. Application Data

(60) Provisional application No. 61/056,212, filed on May 27, 2008.

(51) Int. Cl.
*A63C 19/10* (2006.01)
*E01C 5/00* (2006.01)

(52) U.S. Cl.
USPC ..... 472/88; 404/41

(58) Field of Classification Search ..... 472/85–91; 404/6, 9, 34–36, 41; 14/69.5
See application file for complete search history.

(56) References Cited

U.S. PATENT DOCUMENTS

| | | | | |
|---|---|---|---|---|
| 105,138 | A * | 7/1870 | Cauvet | 404/41 |
| 1,412,504 | A * | 4/1922 | Byrne | 404/20 |
| 4,226,064 | A * | 10/1980 | Kraayenhof | 52/180 |
| 5,341,533 | A * | 8/1994 | Seitz | 14/69.5 |
| 6,328,500 | B1 * | 12/2001 | Rubio | 404/32 |
| 7,108,448 | B2 * | 9/2006 | Hagenah | 404/41 |
| 7,594,777 | B2 * | 9/2009 | Chiu | 404/35 |

* cited by examiner

*Primary Examiner* — Kien Nguyen
(74) *Attorney, Agent, or Firm* — McGuireWoods, LLP

(57) ABSTRACT

An apparatus and method is described for providing an indoor track to permit consumers to evaluate a rollable product such as a stroller on different surfaces such a asphalt, cobblestone, brick, grass, and the like. The track may include multiple sections with different compositions that provide different effects on the rollable product so that comparisons might be made between different products when pushed across the track.

23 Claims, 5 Drawing Sheets

APPARATUS AND METHOD FOR PROVIDING AN IN-STORE CUSTOMER TEST TRACK

This application claims priority to U.S. Provisional application 61/056,212, filed May 27, 2008, entitled "APPARATUS AND METHOD FOR PROVIDING AN IN-STORE CUSTOMER TEST TRACK, the content of which is incorporated by reference herein in its entirety.

BACKGROUND OF THE INVENTION

1. Field of the Invention

The invention relates generally to an apparatus and method for providing an in-store test track that permits customers to test rollable products and, more particularly, to an apparatus and method for providing an in-store test track having multiple real world surface-types for a customer to test a rollable product prior to a purchase or to compare products.

2. Related Art

Currently consumers have minimal, if any, opportunity to test a product that is configured for rolling over various surfaces. In the case of children's products, such as strollers or tricycles for example, there is no meaningful way for the consumer to test or compare the stability and safety of these products in actual use prior to purchase. Such a consumer typically purchases the product "on faith," with minimal real usage exposure to the product.

Parents are becoming much more alert or sensitive to functional aspects of their children's equipment and toys. In the case of a stroller, the suitability of the stroller in various "rolling" conditions is unknown to the consumer, with potential unsatisfactory end results.

From a merchant's point of view, promotional mechanisms or sales techniques that provide advantages in distinguishing themselves over competitors may be of significant interest. And, for some merchants, simply providing better service to consumers creates stronger customer relations, with hopes of a better image with better long term business prospects.

One way for merchants to gain a competitive advantage would be to permit "real world" comparisons among rolling types of products, or simply to permit a consumer to evaluate the functional responsiveness and dependability of the product prior to purchasing. In this way, a consumer (e.g., a parent) may be more confident in the purchase and develop a better regard for the merchant overall.

SUMMARY OF THE INVENTION

The problems above are overcome and the expectations achieved by an in-door track constructed according to principles of the invention. Customer satisfaction and merchant ability to facilitate the customer's satisfaction may be achieved by providing an in-door track having multiple sections with different surface characteristics or composition so that the consumer may evaluate performance of rollable products on the different surfaces.

In one aspect, an apparatus for evaluating rolling products is provided. The apparatus includes a track configurable to include a plurality of sections wherein each section comprises a different surface material to simulate different effects on a rolling product when pushed across the track, wherein a subset of the plurality of sections is configured with a first side vertical wall having a lateral radius and configured with a second side vertical wall having a lateral radius changing a direction of the track laterally from a first direction to a second direction, and wherein the track is configured with a floor and each wall being configured perpendicular to the floor.

In one aspect, an apparatus for evaluating rolling products is provided. The apparatus includes a plurality of track sections, each having different surface features and different materials and wherein each track section is configured with a plurality of walls perpendicular to a track floor, each wall creating a side of one of the track sections, wherein the different surface features simulate at least any one of: asphalt, gravel, brick, grass, cobble stone, and wherein at least one of the plurality of track sections is configured with four sides and at least one other of the plurality of track sections is configured with six sides.

In one aspect, an apparatus for evaluating rolling products is provided. The apparatus includes a plurality of track sections including a first section and a second section, each of the plurality of sections having a surface, the first section configured to be connectable and disconnectable with the second section, and at least one of the plurality of track sections configured with at least one surface feature including a hump for simulating an effect on a rolling product, and at least two of the plurality of sections comprising different materials, and wherein the first section is configured with four side walls and the second section is configured with at least five side walls, each side wall configured perpendicular to the surface.

In one aspect, an apparatus for evaluating rolling products is provided. The apparatus includes a track having a plurality of sections, each section having a different surface composition to simulate different effects on a rolling product when pushed across the track.

In another aspect, a method for providing an in-door track for consumers to evaluate rollable products is provided. The method includes providing a track having a plurality of sections, each section having a different surface composition to simulate different rolling effects and pushing a rollable product across the plurality of sections to observe the effects of the different surface compositions on the rollable product so that a decision to purchase the rollable product based on the observed effects.

In another aspect, a test track is provided that includes a plurality of track sections, each having different surface features and at least one surface include at least any one of: a simulated pot hole, a rumble strip, and a simulated hump, wherein the different surface features simulate at least any one of: asphalt, gravel, brick, grass, cobble stone.

DETAILED DESCRIPTION OF THE INVENTION

Figure 1:
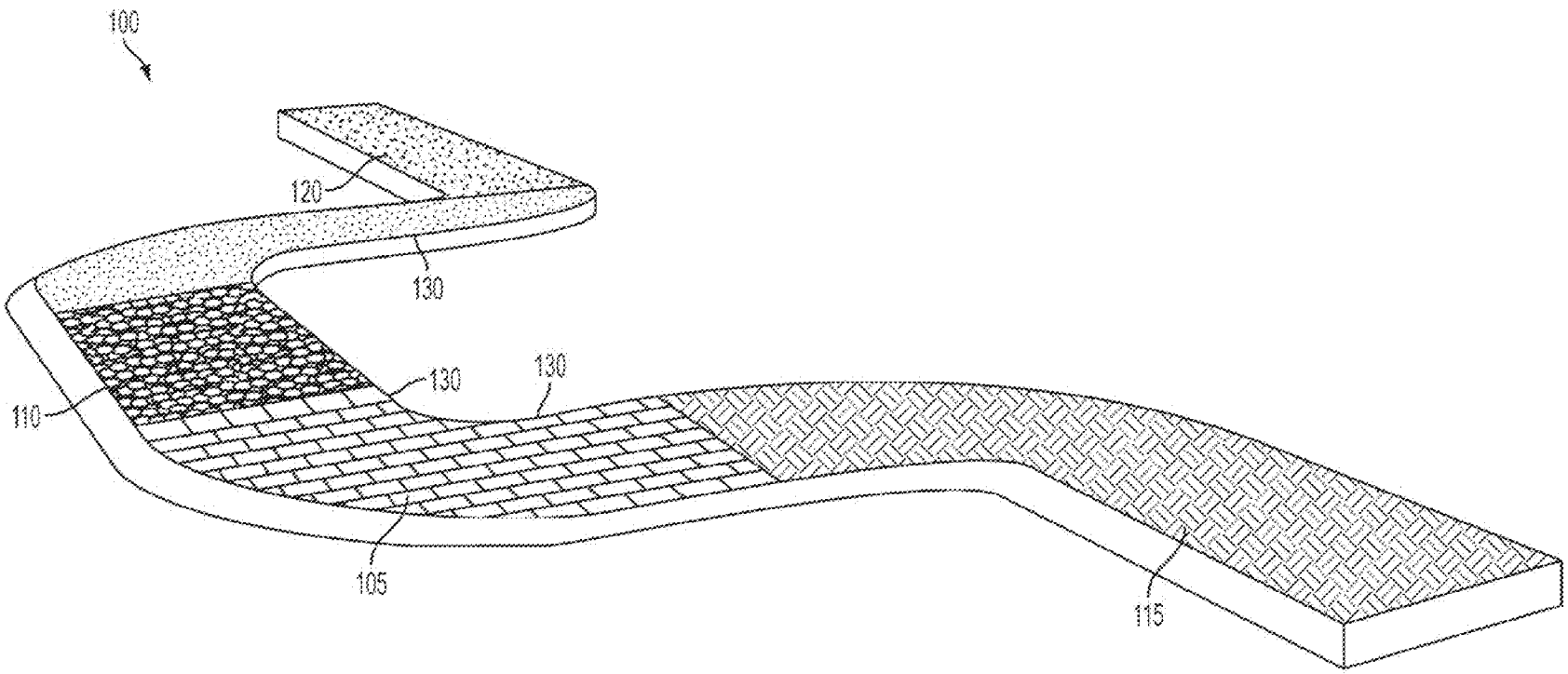
FIG. 1 is an illustration of an embodiment of an indoor track for evaluating rollable products.

The embodiments of the invention and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law. Moreover, it is noted that like reference numerals represent similar parts throughout the several views of the drawings.

It is understood that the invention is not limited to the particular methodology, protocols, devices, apparatuses, materials, applications, etc., described herein, as these may vary. It is also to be understood that the terminology used herein is used for the purpose of describing particular embodiments only, and is not intended to limit the scope of the invention. It must be noted that as used herein and in the appended claims, the singular forms "a," "an," and "the" include plural reference unless the context clearly dictates otherwise.

Unless defined otherwise, all technical and scientific terms used herein have the same meanings as commonly understood by one of ordinary skill in the art to which this invention belongs. Preferred methods, devices, and materials are described, although any methods and materials similar or equivalent to those described herein can be used in the practice or testing of the invention. All dimensions herein are exemplary and may vary.

The apparatus and method of the invention includes providing consumers with an indoor track (e.g., in a retail store) for experimentation that has various types of surfaces that might be encountered during "real-world" usage of a rolling or rollable type of product such as a baby stroller or tricycle, for example. In this way, a consumer may evaluate the performance of the product under different surface conditions to ascertain suitability of the product for the consumer's purpose. Often the structure and design of the product under differing conditions (i.e., differing surfaces) may cause unforeseen issues that may give rise for concern, or conversely, the structure and design may provide a positive or favorable impression on the consumer under differing conditions.

FIG. 1 is an illustration of an embodiment of an indoor track for evaluating rollable products, generally denoted by reference numeral 100. The track 100 comprises a walk-way 130 that may be configured with one or more curves along the walkway 130. The walkway 130 may be configured as multiple sections 105, 110, 115, 120 with each section 105, 110, 115, 120 having different surface characteristics to simulate various surface situations that may be encountered when pushing or pulling a rollable product after purchase, e.g., outside the store (such as streets, parks, homes, sidewalks, parks, and the like). For example, section 105 may comprise a brick surface to provide moderate vibration effects, or other motion related results, to the rollable product under evaluation. Section 110 may comprise cobblestone to provide different rolling characteristics with different variation effects as compared with the brick section 105 (and/or other sections), for example. Section 115 may comprise artificial grass to simulate real grass, with rolling effects related to grass. Section 120 may comprise asphalt. Other type of surfaces such as stone, dirt, sand, planking such as often found on piers, may also comprise the one or more sections of the walkway 130. If a loose type of surface is employed such as stone or sand, then the section may also have retaining ridges along the outer edges (and between sections) to contain the loose surface.

Figure 2A:
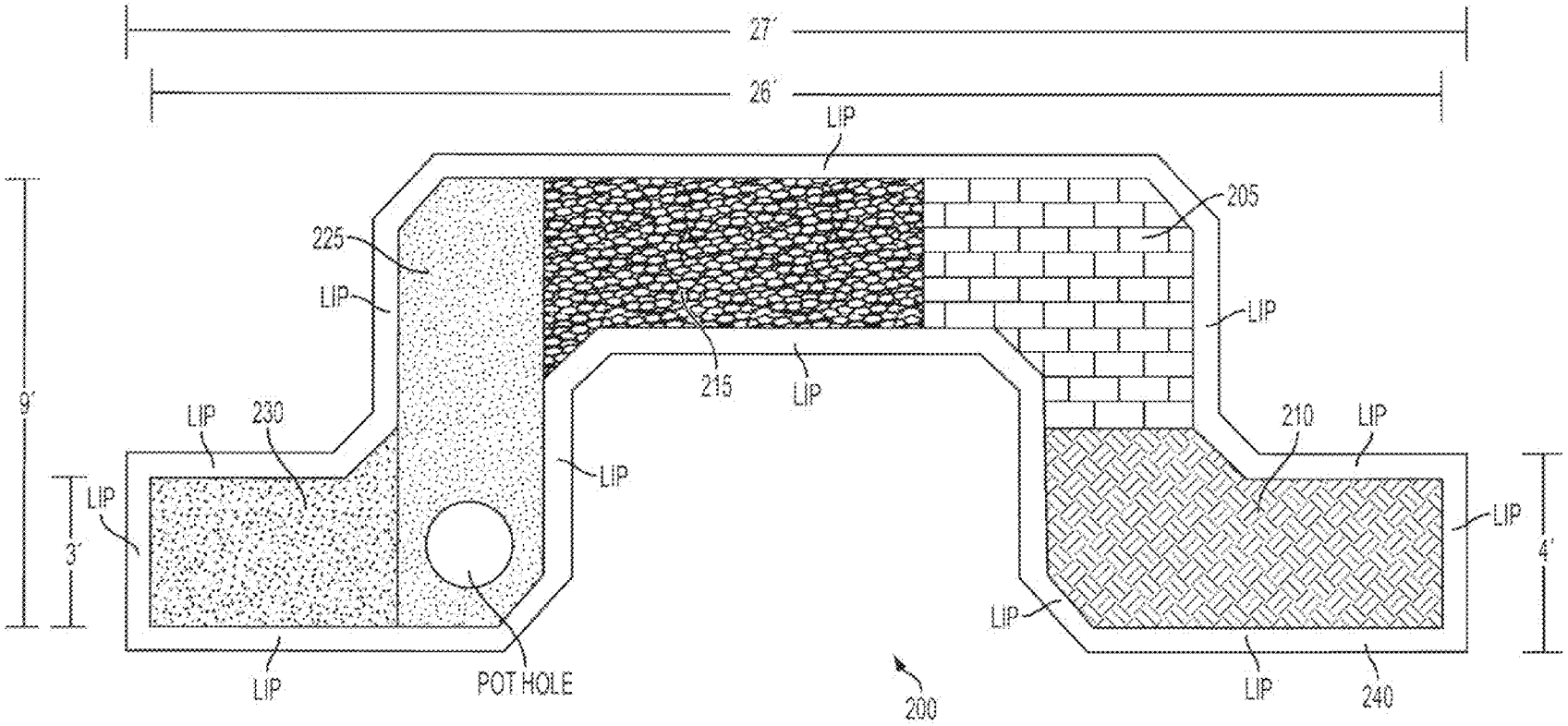
FIG. 2A is a schematic of an embodiment of an indoor walkway, according to principles of the invention.

FIG. 2A is a schematic of an embodiment of an indoor walkway, according to principles of the invention, generally denoted by reference numeral 200. The walkway 200 comprises multiple sections which may include a brick section 205, a grass section 210, a cobble stone section 215 and an asphalt section 225. The gravel section 230, being a loose type mixture, may be contained by an elevated edge to keep the gravel within the section boundaries. Other surface types are also contemplated by the invention. Each section has characteristics that are unique to the surface and provides a consumer with an opportunity to evaluate a rolling product's response to each surface. Other surfaces may also be employed. The section may include at least one contour to change the elevation (up or down) of at least a portion of the walkway surface. The surfaces may include at least one simulated "pot-hole" effect (e.g., a concave depression). The sections 205, 210, 215, 225 may be constructed so that they are removable and re-connectable to another section (e.g., a different section) to re-order the sequence of sections. In some embodiments, multiple sections of the same type (e.g., gravel section 230) may be employed in any order.

Figure 2B:
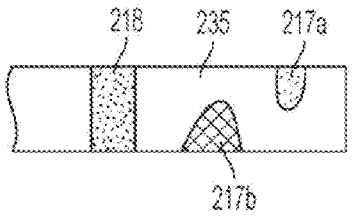
FIG. 2B is a schematic of a walkway section with contour effects, according to principles of the invention.

FIG. 2B is a schematic of a walkway section with contour effects, according to principles of the invention. The exemplary walkway section 235 is shown with a raised "convex" hump 217*a*, and a sunken "concave" bump 217*b*. Moreover, the section 235 is shown having a raised hump 218 across the width of the walkway section 235, but may alternatively be a lowered bump. Each of these contour effects provides an experience for testing a rolling type of product such as a stroller. The contours and surfaces may generate vibrations or create bouncing effects on the rolling product for consumer observation. Other contour effects may be included on the walkway to simulate the related effect, such as rumble strips, and/or a series of humps or bumps, either partially or fully extending across the walkway section 235. Moreover, the walkway may have one or more slopes that have one side of the walkway elevated as compared with the opposite side of the walkway to provide a modest "tipping" effect. The rolling resistance of a stroller, for example, against each type of surface may also be ascertained.

The track may be made from plastic or other composite material and is preferably about three feet wide, but may vary. The length of each section is preferably seven feet long, but may also vary. The overall track length is about forty feet in the preferred embodiment, but may vary.

The indoor track described herein permits customers of a store to push rolling products, such as premium strollers, around different surfaces and to evaluate performance in reference to different models or brands. This allows the customer to understand how the different strollers or rolling product work and perform and allows them to feel confident about a purchase decision.

Figure 3:
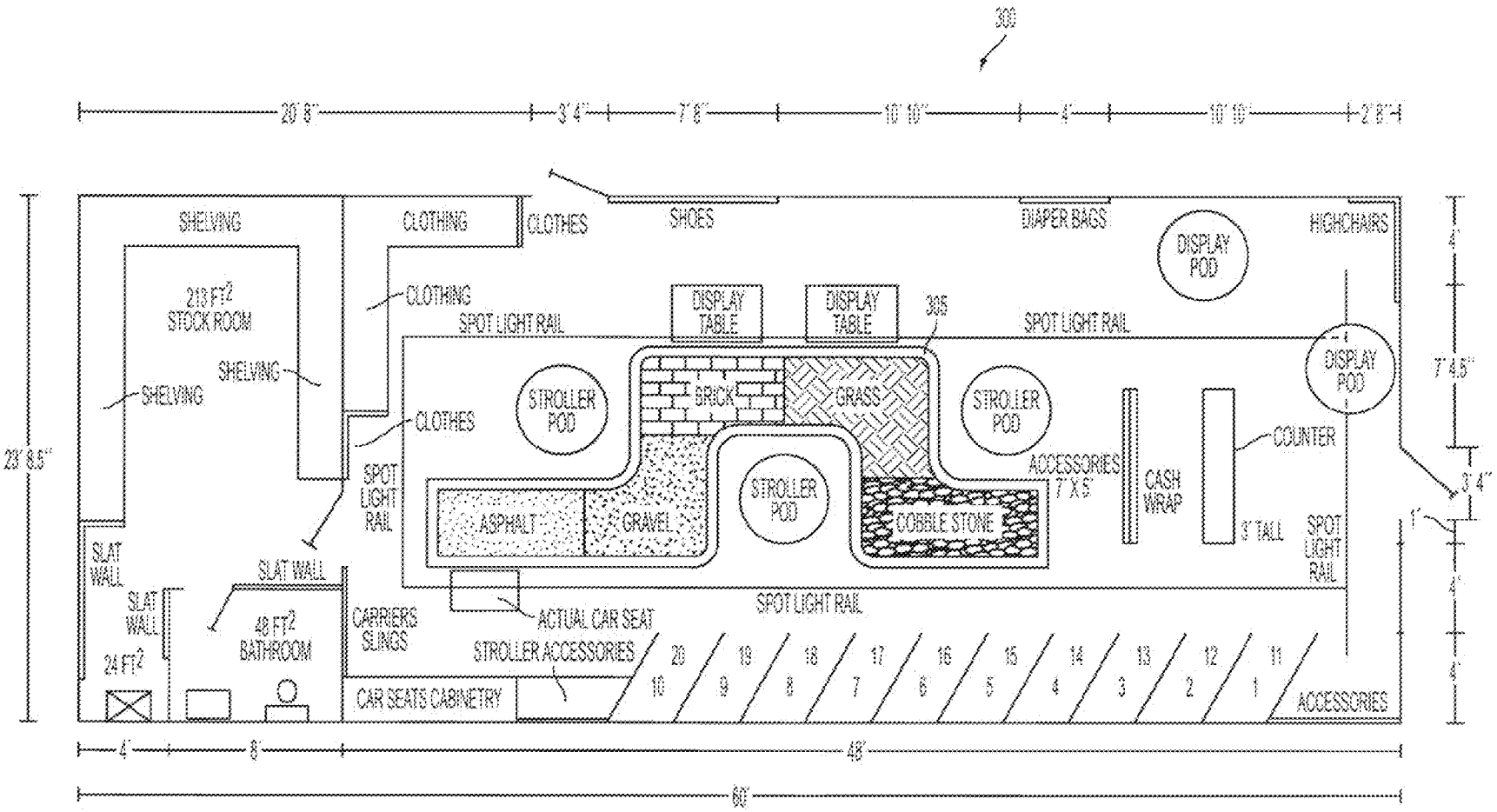
FIG. 3 is a schematic of an indoor track, constructed according to principles of the invention, in an exemplary store setting.

FIG. 3 is a schematic of an indoor track, constructed according to principles of the invention, in an exemplary store setting, generally denoted by reference numeral 300. The indoor track 305 is shown with multiple sections including an asphalt section, a gravel section, a brick section, a grass section and a cobblestone section. Other section types are contemplated.

Figure 4:
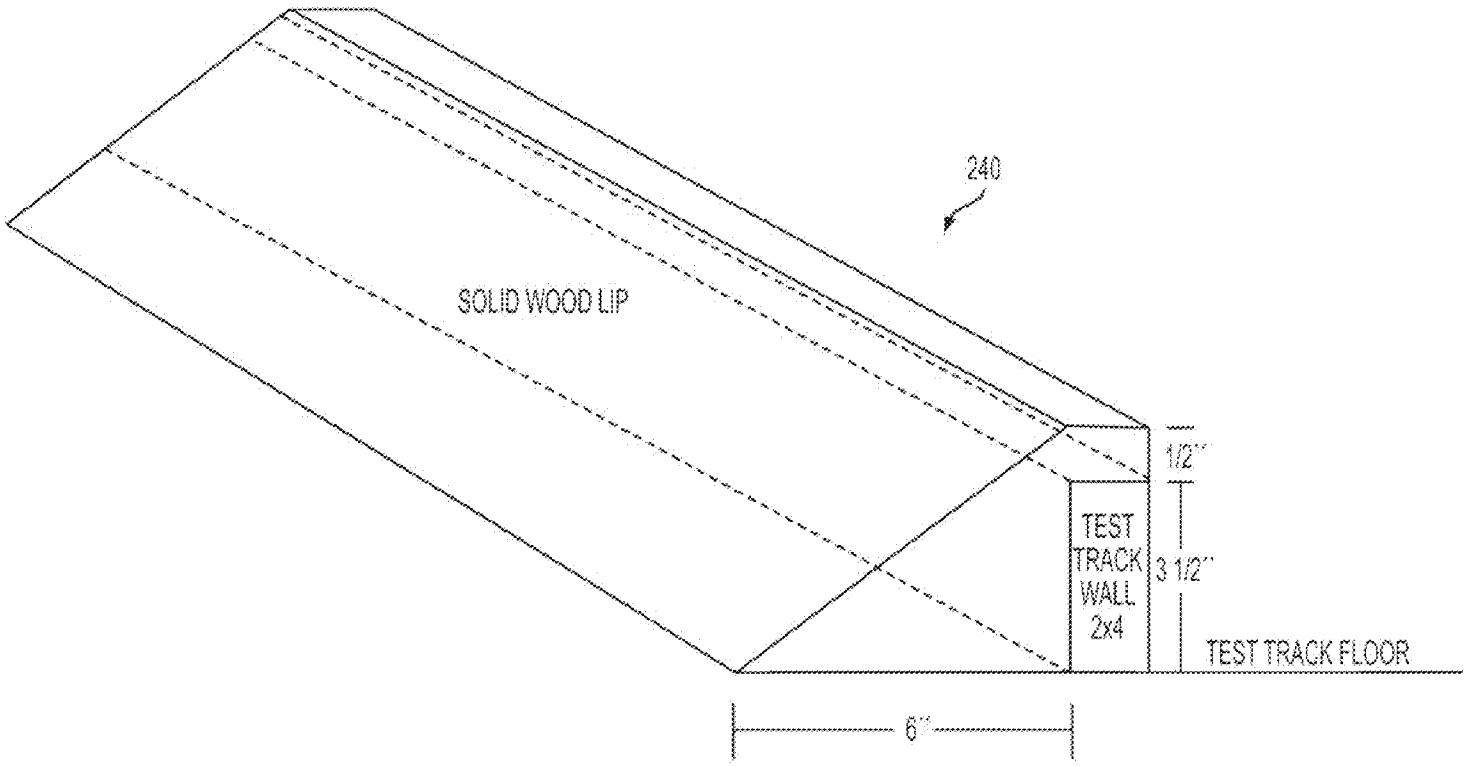
FIG. 4 is a perspective view of a section of an exemplary lip of the indoor walkway of FIG. 2A, constructed according to principles of the invention.

FIG. 4 is a perspective view of an exemplary section of a lip of the indoor walkway of FIG. 2A, constructed according to principles of the invention. The lip 240 may comprise solid wood, but other materials may be utilized such as plastic or composite materials. The dimensions shown are exemplary and may vary. Other orientations and shapes may be employed in other embodiments. The lip 240 may include an incline face to create a type of ramp so that rollable products might be pushed up or down the lip 240 and onto or off the walkway 200 (FIG. 2A). The lip 240 may be removable connectable to one or more sides of the track sections 205, 210, 215, 225, 230.

The examples given above are merely illustrative and are not meant to be an exhaustive list of all possible embodiments, applications or modifications of the invention. Thus, various modifications and variations of the described methods and systems of the invention will be apparent to those skilled in the art without departing from the scope and spirit of the invention. Although the invention has been described in connection with specific embodiments, it should be understood that the invention as claimed should not be unduly limited to such specific embodiments. Indeed, various modifications of the described modes for carrying out the invention which are obvious to those skilled in the art or related fields, given this disclosure, are intended to be within the scope of the appended claims.

What is claimed is:

1. An apparatus for evaluating rolling products, comprising a track configurable to include a plurality of sections wherein each section comprises a different surface material to simulate different effects on a rolling product when pushed across the track, wherein a subset of the plurality of sections is configured with a first side vertical wall having a lateral radius and configured with a second side vertical wall having a lateral radius changing a direction of the track laterally from a first direction to a second direction, and wherein the track is configured with a floor and each wall being configured perpendicular to the floor.

2. The apparatus of claim 1, wherein a second subset of the plurality of sections is configured with a first side vertical wall having a lateral radius and configured with a second side vertical wall having a lateral radius to permit the track to change direction laterally from a second direction to a third direction.

3. The apparatus of claim 1, wherein at least one of the plurality of sections include a contour to change the elevation of at least a portion of the track surface.

4. The apparatus of claim 3, wherein the contour lowers the elevation.

5. The apparatus of claim 3, wherein the contour raises the elevation.

6. The apparatus of claim 3, wherein the contour creates a slope on the surface of at least one of the plurality of sections.

7. The apparatus of claim 1, wherein the surface material is selected from the group comprising asphalt, stone, sand, gravel, cobblestone, brick, concrete, wood, artificial grass, and clay.

8. The apparatus of claim 1, wherein at least one of the plurality of sections has a retaining ridge to retain a loose surface composition.

9. The apparatus of claim 1, wherein the plurality of sections are configurable to change the order of sections in reference to one another.

10. The apparatus of claim 1, where the plurality of sections comprise at least five sections each having different having a different surface material.

11. The track of claim 1, further comprising a lip connectable to the plurality of sections and the lip forming a ramp to permit a rollable product to be pushed onto any of the plurality of track sections, the lip configured around all sides of the track and the lip being configured connectable to a top surface of the vertical walls.

12. An apparatus for evaluating rolling products, comprising:

a plurality of track sections, each having different surface features and different materials and wherein each track section is configured with a plurality of walls perpendicular to a track floor, each wall creating a side of one of the track sections, and wherein the different surface features simulate at least any one of: asphalt, gravel, brick, grass, cobble stone, and wherein at least one of the plurality of track sections is configured with four sides and at least one other of the plurality of track sections is configured with six sides.

13. The apparatus of claim 12, wherein the plurality of track sections are each configured to be disconnected and reconnected to reorder the plurality of track sections.

14. The apparatus of claim 12, further comprising a lip connectable to the plurality of track sections and the lip having an extending portion to mate to a top surface of a wall of one of the track sections and the lip forming a ramp to permit a rollable product to be pushed onto the plurality of track sections.

15. The apparatus of claim 12, wherein at least another one of the plurality of track sections is configured with three sides.

16. The apparatus of claim 12, wherein the at least one other of the plurality of track sections comprise three pairs of parallel opposing sides.

17. An apparatus for evaluating rolling products, comprising:

a plurality of track sections including a first section and a second section, each of the plurality of sections having a surface, the first section configured to be connectable and disconnectable with the second section, and at least one of the plurality of track sections configured with at least one surface feature including a hump for simulating an effect on a rolling product, and at least two of the plurality of sections comprising different materials, and wherein the first section is configured with four side walls and the second section is configured with at least five side walls, each side wall configured perpendicular to the surface.

18. The apparatus of claim 17, wherein the plurality of track sections are configured to be reorderable and reconnectable to each other.

19. The apparatus of claim 17, wherein a surface of at least one track section includes at least any one of: a change in elevation, a rumble strip, a bump, and a pothole.

20. The apparatus of claim 17, wherein the first section and second section have different surface features.

21. The apparatus of claim 17, wherein the simulated hump extends across a width of the at least one of the plurality of track sections.

22. The apparatus of claim 17, wherein the at least five side walls is six side walls and comprise three pairs of parallel opposing walls.

23. The apparatus of claim 17, wherein the simulated hump is of a uniform width extending at least partially across the at least one of the plurality of track sections.

* * * * *